US010287657B2

(12) United States Patent
Bae et al.

(10) Patent No.: US 10,287,657 B2
(45) Date of Patent: May 14, 2019

(54) MAGNESIUM MATERIAL AND METHOD OF MANUFACTURING THE SAME

(71) Applicant: Industry-Academic Cooperation Foundation, Yonsei University, Seoul (KR)

(72) Inventors: DongHyun Bae, Seoul (KR); Hun Kang, Daejeon (KR); SeungWon Kang, Uiwang (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 612 days.

(21) Appl. No.: 14/684,657

(22) Filed: Apr. 13, 2015

(65) Prior Publication Data

US 2015/0292065 A1 Oct. 15, 2015

(30) Foreign Application Priority Data

Apr. 14, 2014 (KR) ..... 10-2014-0044027

(51) Int. Cl.

| | |
|---|---|
| ***C22C 32/00*** | (2006.01) |
| ***C22C 1/00*** | (2006.01) |
| ***C22C 1/02*** | (2006.01) |
| ***C22C 23/00*** | (2006.01) |

(52) U.S. Cl.

CPC ..... *C22C 32/0068* (2013.01); *C22C 1/02* (2013.01); *C22C 23/00* (2013.01)

(58) Field of Classification Search

CPC ..... C04B 41/4539; C22C 23/00; C22C 1/02; C22C 32/0068

USPC ..... 75/600, 351, 612; 420/402, 407

See application file for complete search history.

(56) References Cited

U.S. PATENT DOCUMENTS 4,056,874 A * 11/1977 Kalnin ..... C22C 49/14 148/420

FOREIGN PATENT DOCUMENTS

| | | |
|---|---|---|
| JP | 2006336055 A * | 12/2006 |
| KR | 10-2008-0066580 | 7/2008 |
| KR | 10-2010-0034773 | 4/2010 |

OTHER PUBLICATIONS

English computer translation JP-2006336055-A (Year: 2006).*

* cited by examiner

*Primary Examiner* — Erin B Saad

(57) ABSTRACT

There is provided a Mg—N-A based magnesium material (A is a metal or non-metal element configuring a nitride, N: nitrogen originating from the nitride). The magnesium material includes a spherical Mg—N-A eutectic phase and nitrogen atoms are dispersed in a magnesium matrix, whereby mechanical and ignition properties of the magnesium material are improved, as compared to a magnesium material or pure magnesium material in which the nitrogen atoms are not included and only the metal or non-metal element is included.

4 Claims, 6 Drawing Sheets

MAGNESIUM MATERIAL AND METHOD OF MANUFACTURING THE SAME

CROSS REFERENCE TO RELATED APPLICATION

The present application claims priority from Korean Patent Application Number 10-2014-0044027 filed on Apr. 14, 2014, the entire contents of which are incorporated herein for all purposes by this reference.

BACKGROUND OF THE INVENTION

Field of the Invention

The present invention relates to a magnesium material, and more particularly, to a magnesium material having a structure capable of improving ignition and mechanical properties, and a method of manufacturing the same.

Description of Related Art

Mg (magnesium) is an environmental friendly material that has a density of 1.74 g/cm$^3$, which is merely ⅕ of Fe and ⅔ of Al, and generally has superior strength and can be easily recycled. Mg is also evaluated as an ultra-lightweight structural material, and has the specific strength and elastic coefficient of which are comparable to those of other lightweight materials, such as Al alloy. In addition, Mg exhibits a superior ability to absorb vibration, impact, electromagnetic wave and the like, and has superior electrical and thermal conductivities.

However, Mg and Mg alloys (hereinafter, also collectively referred to as magnesium material) have the fundamental problem of poor corrosion resistance despite of the above-mentioned excellent characteristics. Since it is known that Mg rapidly corrodes under electromotive force (EMF) and in a galvanic reaction due to its high reactivity, the use of Mg is limited to internal parts in which corrosion environment conditions are not strict or regions in which strength, thermal resistance and corrosion resistance are not highly required. Therefore, although a technology for fundamentally improving the corrosion resistance of Mg and Mg alloys is still required, this requirement is not satisfied by present technologies.

In the meantime, it has been known a method of forming a coating on a surface of a material so as to improve the corrosion resistance. For example, Korean Patent Application Publication No. 10-2008-66580A discloses a surface treatment method of an aluminum alloy. A coating layer is formed through processes of removing an aluminum oxide film, forming a nickel-plated film, forming an electroless copper plated film, and the like, so that an aluminum matrix is protected.

Also, the Mg material melted at high temperatures, i.e., the molten Mg material is likely to ignite. Usually, when Mg is melted at 640° C., it immediately ignites, and Mg alloys ignite at about 400° C. in many cases. In order to increase the ignition temperature, a protective gas such as $SF_6$ and $SO_2$ is used. However, the protective gas is harmful to a human body and corrodes an equipment, so that the use thereof is strictly limited. Regarding this, Korean Patent Registration No. 10-1045218 discloses a technology of adding an additive such as $CaC_2$, $CaCO_3$ and the like to the molten magnesium so as to reduce a using amount of the protective gas and to improve the ignition property.

The information disclosed in the Background of the Invention section is provided only for enhancement of (or better) understanding of the background of the invention, and should not be taken as an acknowledgment or any form of suggestion that this information forms a prior art that would already be known to a person skilled in the art.

BRIEF SUMMARY OF THE INVENTION

Various aspects of the present invention provide a magnesium material of which ignition and mechanical properties are improved using nano-powder particles without adding a separate additive, and a manufacturing method thereof.

Also provided are a magnesium material of which ignition and mechanical properties are improved by adding nitride particles to a molten magnesium material by using a casting method having excellent industrial applicability, and a manufacturing method thereof.

In an aspect of the present invention, there is provided a Mg—N-A based magnesium material (A is a metal or non-metal element configuring a nitride, N: nitrogen originating from the nitride) wherein the magnesium material comprises a spherical Mg—N-A eutectic phase, and wherein nitrogen atoms are dispersed in a magnesium matrix to improve mechanical and ignition properties of the magnesium material, as compared to a magnesium material or pure magnesium material in which the nitrogen atoms are not included and only the metal or non-metal element is included.

According to an illustrative embodiment of the present invention, the magnesium material may be expressed by $Mg_{100-x-y}N_xA_y$ in which x and y are respectively 20 wt % or less.

According to an illustrative embodiment of the present invention, the nitride may be one or more nitrides selected from a group consisting of SiNx, CuNx, ZnNx, YNx, ZrNx, CNx, MgNx, AlNx, TiNx and CuNx.

According to an illustrative embodiment of the present invention, the magnesium material may further comprise one or more elements selected from a group consisting of calcium (Ca), beryllium (Be), aluminum (Al), silicon (Si), cobalt (Co), nickel (Ni), copper (Cu), zinc (Zn), gallium (Ga), yttrium (Y), germanium (Ge), palladium (Pd), silver (Ag), cadmium (Cd), indium (In), tin (Sn), antimony (Sb), lead (Pb), bismuth (Bi), manganese (Mn), molybdenum (Mo), phosphorous (P), boron (B) and strontium (Sr).

According to an illustrative embodiment of the present invention, a size of the nitride particle may be 100 nm or less.

In an aspect of the present invention, provided is a method of manufacturing a magnesium material including the steps of preparing a molten material of magnesium material, and adding nitride into the molten material to decompose the nitride, to disperse nitrogen atoms configuring the nitride into a matrix of the magnesium material, and to enable the nitrogen atoms and a metal or non-metal element configuring the nitride particles to form a spherical eutectic phase with magnesium, thereby manufacturing a cast material in which the nitrogen atoms are dispersed and which includes the eutectic phase.

According to an illustrative embodiment of the method, the magnesium material manufactured by the method has improved mechanical and ignition properties, as compared to a magnesium material or pure magnesium material in which the nitrogen atoms are not included and only the metal or non-metal elements are included.

According to an illustrative embodiment of the method, the nitride may be one or more nitrides selected from a group consisting of SiNx, CuNx, ZnNx, YNx, ZrNx, CNx, MgNx, AlNx, TiNx and CuNx.

According to an illustrative embodiment of the method, the method may further include the step of adding one or more elements selected from a group consisting of calcium (Ca), beryllium (Be), aluminum (Al), silicon (Si), cobalt (Co), nickel (Ni), copper (Cu), zinc (Zn), gallium (Ga), yttrium (Y), germanium (Ge), palladium (Pd), silver (Ag), cadmium (Cd), indium (In), tin (Sn), antimony (Sb), lead (Pb), bismuth (Bi), manganese (Mn), molybdenum (Mo), phosphorous (P), boron (B) and strontium (Sr) to the molten material.

According to an illustrative embodiment of the method, a size of the nitride particle may be 100 nm or less.

As set forth above, according to the magnesium material of the present invention, the nitrogen atoms are dispersed in the matrix thereof and the metal or non-metal element configuring the nitride and the nitrogen atoms form a substantially spherical eutectic phase with magnesium. Thereby, it is possible to improve the ignition and mechanical properties thereof.

The materials and methods of the present invention have other features and advantages which will be apparent from, or are set forth in greater detail in the accompanying drawings, which are incorporated herein, and in the following Detailed Description of the Invention, which together serve to explain certain principles of the present invention.

DETAILED DESCRIPTION OF THE INVENTION

Reference will now be made in detail to exemplary embodiments of the present invention in conjunction with the accompanying drawings. Herein, detailed descriptions of some technical constructions or terms well known in the art will be omitted. Even if such descriptions are omitted, the features of the present invention will be apparent to a person skilled in the art from the following description.

Figure 1:
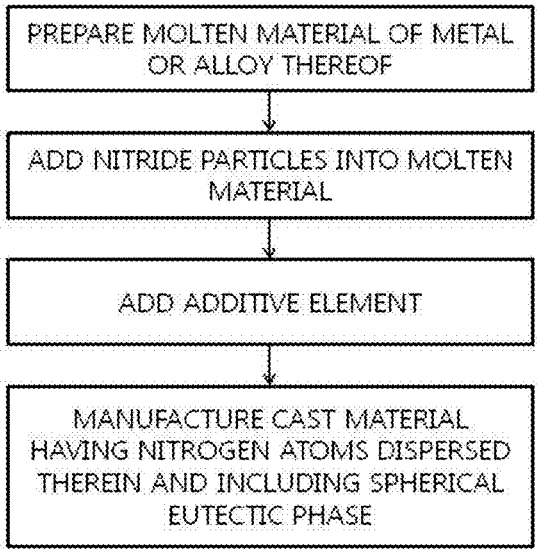
FIG. 1 is a flowchart showing schematic processes of manufacturing a magnesium material having nitrogen atoms included therein according to an illustrative embodiment of the present invention.

FIG. 1 schematically shows processes of manufacturing a magnesium material according to an illustrative embodiment of the present invention.

As shown in FIG. 1, the inventors selected magnesium (metal material) and silicon nitride particles ($Si_3N_4$, 50 nm) as a matrix material and nitride nano-particles, respectively, manufactured a magnesium material in accordance with following processes and evaluated properties thereof.

First, the inventors added the nitride nano-particles to a molten matrix material by using a general casting method, and could obtain unexpected results. Specifically, pure magnesium was melted using an electric melting furnace and then nitride (silicon nitride) nano-particle powders ($Si_3N_4$, 50 nm) were input to the molten material by 1 vol %. At this time, the silicon nitride nano-particle powders were not directly input to the molten material. That is, in order to prevent the silicon nitride nano-particle powders from floating, a bulk material was first manufactured by applying a pressure to the powders within a pressure range in which the powders are not damaged. Then, the bulk material was input to the molten material. The temperature of the molten material was increased to about 700° C. and was kept for 60 minutes so that the powders could be decomposed. Then, the molten material was cast to manufacture a cast material. Also, a protective gas ($SF_6$+$CO_2$) was used throughout the manufacturing process so as to prevent oxidation and ignition of the magnesium material.

Figure 2:
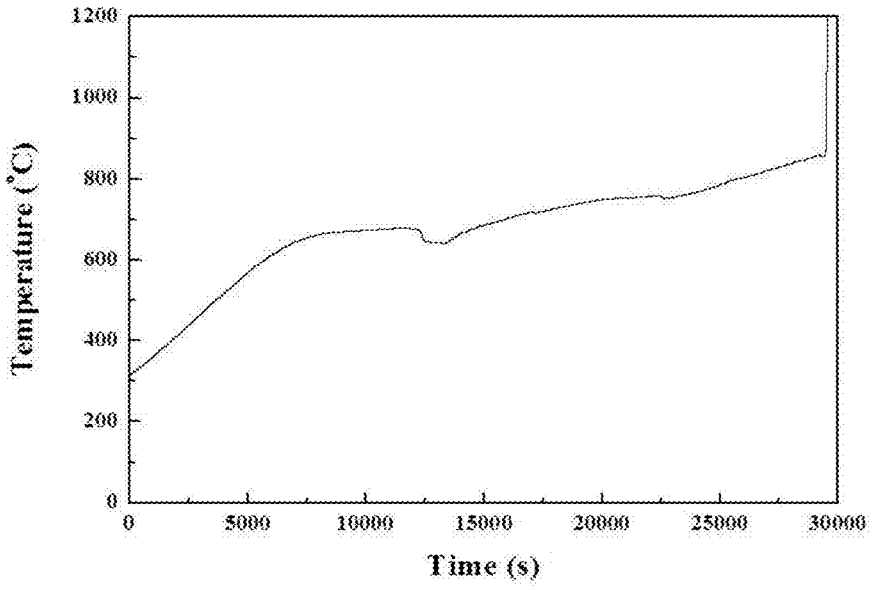
FIG. 2 is a graph showing a test result in terms of an ignition property of the magnesium material manufactured according to the illustrative embodiment.

FIG. 2 shows a test result in terms of the ignition property of the material by remelting the manufactured magnesium material (i.e., the manufactured cast material was solidified to be a solid phase, which was then again melted). Specifically, it can be seen from FIG. 2 that the manufactured magnesium material was melted at about 678° C., the molten material exhibited the thermal stability up to about 850° C. and the ignition started at temperatures of 850° C. or higher. The ignition temperature is significantly increased, as compared to a conventional magnesium material.

Figure 3:
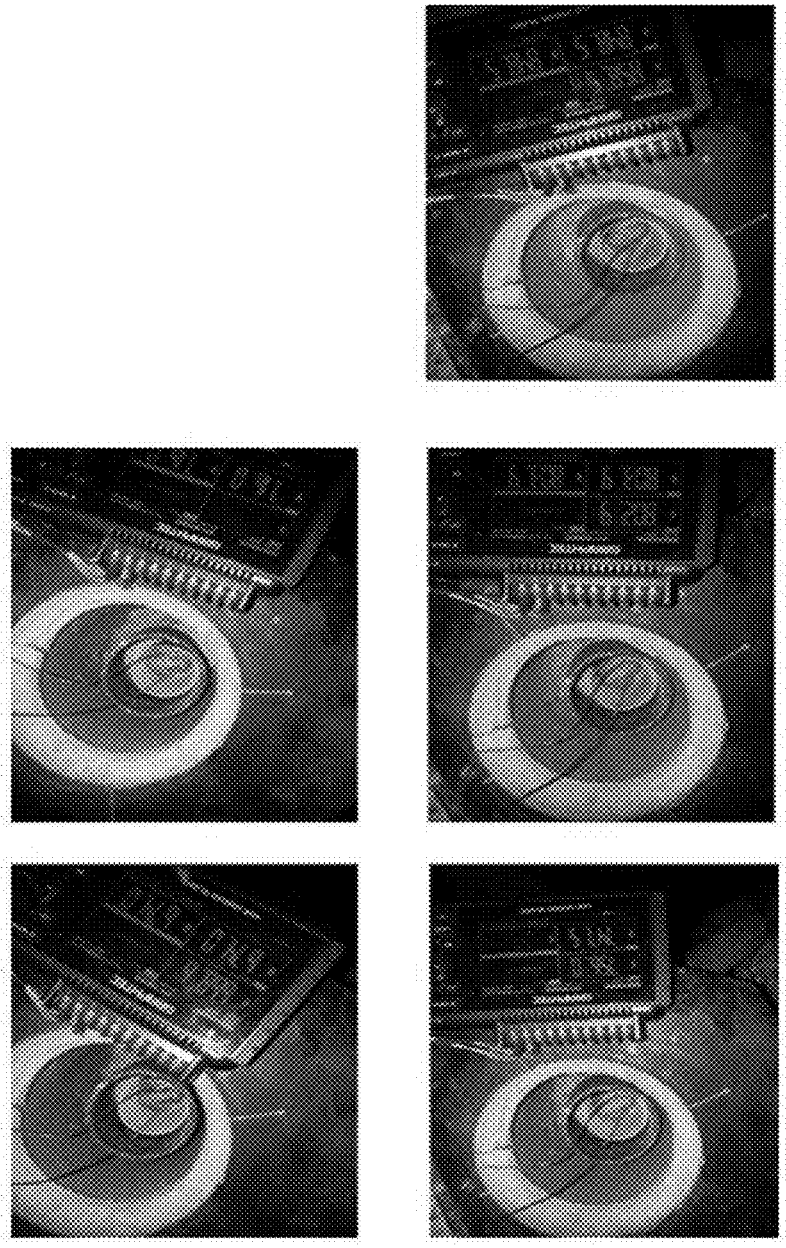
FIG. 3 is photographs of a molten magnesium material taken at an interval of 50° C.

FIG. 3 is photographs of a molten material of the above manufactured magnesium material, which are taken at an interval of 50° C. from 680° C. to 850° C.

As described above, in order to analyze the reason to improve the ignition property, the inventors analyzed a micro structure of the manufactured magnesium material. Specifically, the magnesium material (the material manufactured by adding the silicon nitride nano-particle powders) and a material manufactured by adding only silicon (Si) to magnesium by the same mass ratio as the silicon nitride nano-particle powders were observed with a scanning electron microscope. The results are shown in FIG. 4.

Figure 4:
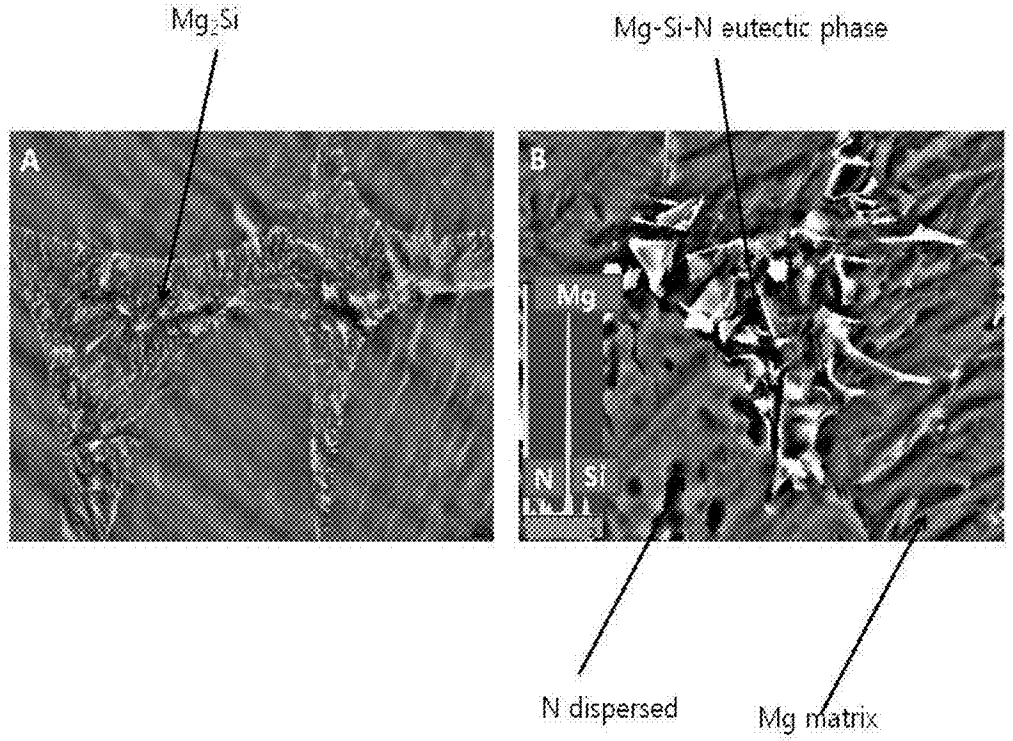
FIG. 4 is microscope photographs showing micro structures of a magnesium material (a comparative example) having only Si added thereto and a magnesium material (an illustrative embodiment) manufactured by adding silicon nitride particles.

As shown in FIG. 4, the magnesium material manufactured by adding only Si and the magnesium material manufactured according to the above illustrative embodiment have totally different structures. That is, in the magnesium material manufactured by adding only Si (refer to a left photograph of FIG. 4), only a eutectic phase ($Mg_2Si$) having a lamella structure of magnesium and silicon is observed. In contrast, in the magnesium material manufactured by adding silicon nitride according to the above illustrative embodiment (refer to a right photograph of FIG. 4), eutectic phases are agglomerated to form a substantially spherical eutectic phase. Also, the eutectic phase consists of Mg—Si—N (refer to an inset in FIG. 4), and nitrogen atoms originating from the silicon nitride are dispersed in the magnesium matrix. That is, it seems that the nitride is decomposed and the nitrogen atoms configuring the nitride are diffused and dispersed in the magnesium matrix. It also seems that the ignition property of the magnesium material of the illustrative embodiment has been improved by the micro structure. That is, when the nitride nano-particles are input to the molten material, the metal or non-metal element (Si, in the illustrative embodiment) configuring the nitride and nitrogen atoms form the spherical eutectic phase with magnesium, and some nitrogen atoms are dispersed in the magnesium matrix, so that the exceptional ignition property improvement effect is exhibited. In the meantime, when a size of the nitride nano-particle is greater than 100 nm, an energy barrier for diffusion is not sufficiently lowered, so that the diffusion is not made well even though the thermal energy is applied. Therefore, according to the manufacturing method of the present invention, it is preferably to use the nitride nano-particles having a size of about 100 nm or less, from a standpoint of the energy barrier.

Like this, the magnesium material of the present invention can be expressed by a formula of $Mg_{100-x-y}N_xA_y$ in which A is a metal or non-metal element configuring a nitride, N is nitrogen originating from the nitride, and x and y are respectively 20 wt % or less in a total weight of the magnesium material. That is, when an amount of an addition element is added by 20% or greater of a magnesium material, it is difficult to consider it as a magnesium material.

Further, the inventors performed a tensile test so as to analyze the mechanical properties of the manufactured magnesium materials. The results are shown in a graph of FIG. 5.

Figure 5:
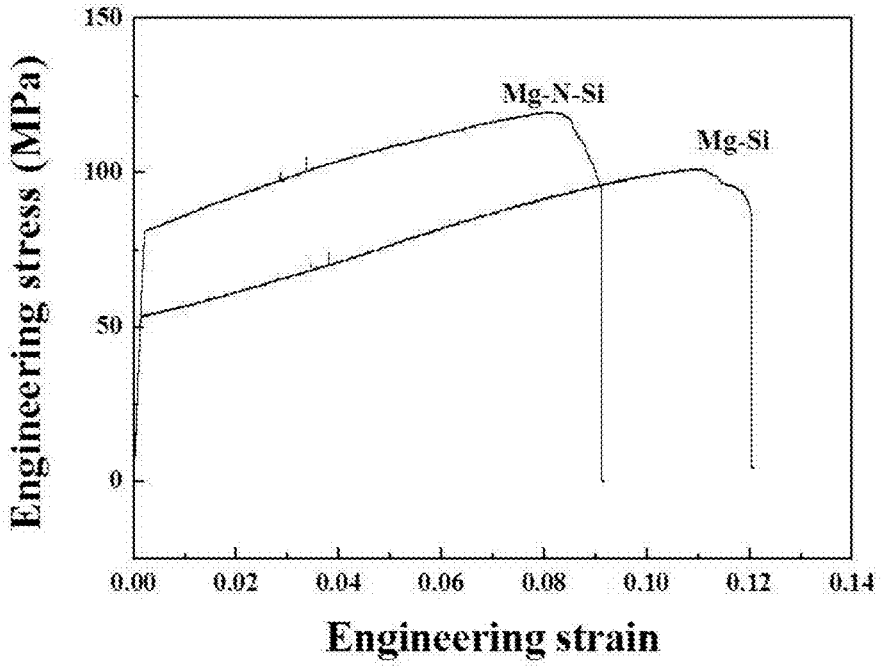
FIG. 5 is a graph showing mechanical properties of the magnesium material (a comparative example) having only Si added thereto and the magnesium material (an illustrative embodiment) manufactured by adding silicon nitride particles.

As shown in FIG. 5, a yield strength of the magnesium material of the above illustrative embodiment was increased by about 30 MPa, as compared to a yield strength of the magnesium material in which only silicon was added. It seems that the increase in the yield strength results from the influence of the nitrogen atoms, which are entered into solid solution and are dispersed in the magnesium matrix.

Figure 6:
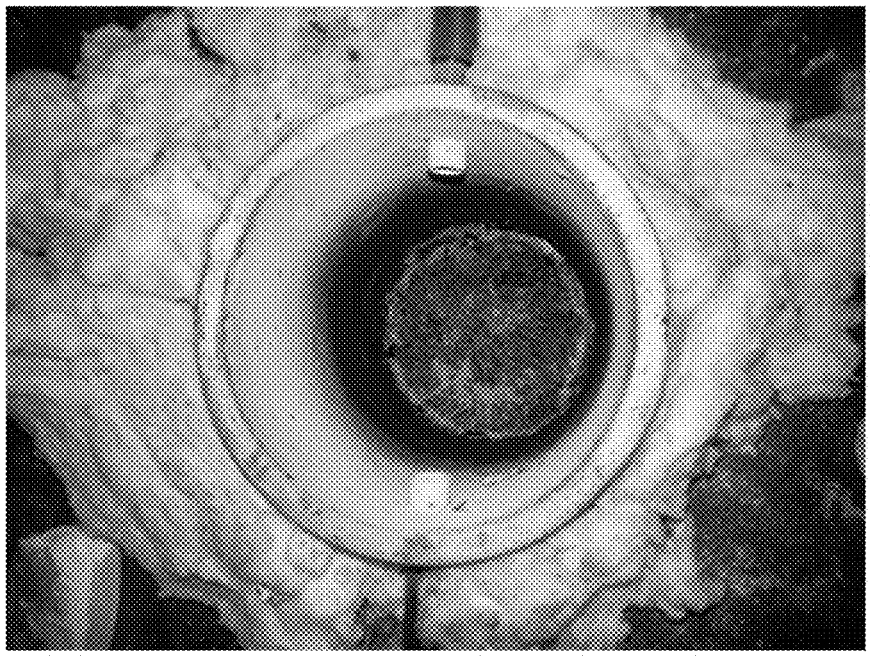
FIG. 6 is a photograph of a molten material in which calcium is added to the magnesium material of the illustrative embodiment.

Also, in order to check whether the thermal stability between the above-manufactured magnesium material and an additive element is kept, the inventors added calcium (Ca) of 0.5% (mass ratio) to manufacture a magnesium material having a composition of Mg—N—Si—Ca in accordance with the above-described processes, performed ignition and tensile tests and confirmed that the substantially same tendency as the above-manufactured magnesium material is exhibited. FIG. 6 is a photograph of a molten material for which the ignition property of the magnesium material having calcium added thereto was tested, in which a photograph of a molten magnesium material melted without the protective gas is presented. As shown, even though the specific element (Ca) was added for a predetermined purpose, it can be seen that the ignition was not caused.

Although the present invention has been described in relation to the certain exemplary embodiments, it should be understood that the present invention is not limited thereto. The foregoing embodiments can be made into various alterations and modifications without departing from the scope of the appended Claims, and all such alterations and modifications fall within the scope of the present invention. For example, the ceramic particles, i.e., silicon nitride ($Si_3N_4$) particles have been exemplified in the illustrative embodiment. However, it should be noted that one or more nitride nano-particles selected from a nitride group having metal or non-metal element and nitrogen, such as CuNx, ZnNx, YNx, ZrNx, CNx, MgNx, AlNx, TiNx and CuNx, can be applied to the present invention and the corresponding particles can be decomposed and dispersed in a magnesium matrix and can improve the mechanical and ignition properties and the thermal stability of the molten material.

In the meantime, calcium (Ca) has been exemplified as an element that is added for a predetermined purpose. However, the present invention is not limited thereto. For example, in order to provide a magnesium alloy with a predetermined property, one or more elements of beryllium (Be), aluminum (Al), silicon (Si), cobalt (Co), nickel (Ni), copper (Cu), zinc (Zn), gallium (Ga), yttrium (Y), germanium (Ge), palladium (Pd), silver (Ag), cadmium (Cd), indium (In), tin (Sn), antimony (Sb), lead (Pb), bismuth (Bi), manganese (Mn), molybdenum (Mo), phosphorous (P), boron (B) and strontium (Sr) can be selected and added, in addition to the calcium (Ca).

Like this, the present invention can be diversely modified and changed, which are all included within the scope of the present invention. Therefore, the present invention shall be defined by only the claims and their equivalents.

The invention claimed is:

1. A magnesium alloy having a composition of Mg—N-A (A: a metal or non-metal element decomposed from a nitride particle including the metal or non-metal element, and N: nitrogen atoms decomposed from the nitride particle), wherein the magnesium alloy comprising:

a magnesium matrix;

some of the nitrogen atoms solid-solutioned in the magnesium matrix; and eutectic phases formed by Mg of the magnesium alloy, the metal or non-metal element, and a rest of the nitrogen atoms, thereby improving mechanical and ignition properties of the magnesium alloy as compared to a magnesium material or pure magnesium material in which the nitrogen atoms are not included and only the metal or non-metal element is included, wherein the metal or non-metal element and the nitrogen atoms have 20 wt % or less, respectively in the magnesium alloy.

2. The magnesium alloy according to claim 1, wherein the nitride particle is one or more nitrides selected from a group consisting of SiNx, CuNx, ZnNx, YNx, ZrNx, CNx, MgNx, AlNx, TiNx and CuNx.

3. The magnesium alloy according to claim 2, wherein the magnesium material further comprises one or more elements selected from a group consisting of calcium (Ca), beryllium (Be), aluminum (Al), silicon (Si), cobalt (Co), nickel (Ni), copper (Cu), zinc (Zn), gallium (Ga), yttrium (Y), germanium (Ge), palladium (Pd), silver (Ag), cadmium (cd), indium (In), tin (Sn), lead (Pb), bismuth (Bi), manganese (Mn), molybdenum (Mo), phosphorous (P), boron (B) and strontium (Sr).

4. A magnesium alloy having a composition of Mg—N-A (A: a metal or non-metal element decomposed from a nitride particle including the metal or non-metal element, and N: nitrogen atoms decomposed from the nitride particle), wherein the magnesium alloy comprising:

a magnesium matrix;

some of the nitrogen atoms solid-solutioned in the magnesium matrix; and eutectic phases formed by Mg of the magnesium alloy, the metal or non-metal element, and a rest of the nitrogen atoms, thereby improving mechanical and ignition properties of the magnesium alloy as compared to a magnesium material or pure magnesium material in which the nitrogen atoms are not included and only the metal or non-metal element is included, wherein the metal or non-metal element and the nitrogen atoms have 20 wt % or less, respectively in the magnesium alloy, wherein the nitride particle comprises a bulk material pressed within a pressure range in which the nitride particle is not damaged, wherein a size of the nitride particle is less than 100 nm.

* * * * *